US005526585A

United States Patent [19]

Brown et al.

[11] Patent Number: 5,526,585

[45] Date of Patent: Jun. 18, 1996

[54] ATTACHMENT DEVICE FOR USE WITH A LACE-SUBSTITUTE HAND-ACTUABLE SHOE-CLOSURE SYSTEM

[76] Inventors: Edward G. Brown; Margot J. Boileau, both of 1460 Greentree Cir., Lake Oswego, Oreg. 97034; Patrick F. Boileau, 5858 SW. Ralston Dr., Portland, Oreg. 97201

[21] Appl. No.: 326,056

[22] Filed: Oct. 19, 1994

Related U.S. Application Data

[63] Continuation of Ser. No. 64,486, May 18, 1993, abandoned.

[51] Int. Cl.[6] ..... A43C 11/00

[52] U.S. Cl. ..... 36/50.100; 36/52

[58] Field of Search ..... 36/50.1, 138, 136, 36/132, 114, 52, 134, 59 R, 62, 65, 67 D, 67 R

[56] References Cited

U.S. PATENT DOCUMENTS

| | | | |
|---|---|---|---|
| 275,942 | 4/1883 | Porter . | |
| 1,361,796 | 12/1920 | Moore | 36/50.1 |
| 1,640,195 | 8/1927 | Kondolf . | |
| 1,995,243 | 3/1935 | Clarke . | |
| 2,074,482 | 3/1937 | Martens . | |
| 2,095,869 | 10/1937 | Hermson . | |
| 2,650,399 | 9/1953 | Torelli . | |
| 2,839,804 | 6/1958 | Benoit . | |
| 2,871,537 | 2/1959 | Hickerson . | |
| 2,925,672 | 2/1960 | Trovato | 36/50.1 |
| 3,137,952 | 6/1964 | Shears . | |
| 3,205,544 | 9/1965 | Streule et al. | 36/50.1 |
| 3,217,371 | 11/1965 | Collins | 36/50.1 |
| 3,279,015 | 10/1966 | Henning | 36/50.1 |
| 3,540,973 | 11/1970 | Johnson | 36/50.1 |
| 3,701,572 | 10/1972 | Velasquez . | |
| 4,210,983 | 7/1980 | Green . | |
| 4,282,657 | 8/1981 | Antonious . | |
| 4,536,975 | 8/1985 | Harrell . | |
| 4,556,207 | 1/1986 | Struntz . | |
| 4,733,439 | 3/1988 | Gentry . | |
| 4,907,352 | 3/1990 | Ginsberg | 36/50.1 |
| 5,029,405 | 7/1991 | DeHaitre | 36/67 D |
| 5,148,614 | 9/1992 | Kelly | 36/50.1 |
| 5,165,190 | 11/1992 | Smyth . | |

FOREIGN PATENT DOCUMENTS

| | | |
|---|---|---|
| 1187839 | 9/1959 | France . |

*Primary Examiner*—Thomas P. Hilliard

*Attorney, Agent, or Firm*—Kolisch Hartwell Dickinson McCormack & Heuser

[57] ABSTRACT

An attachment device is described that is fittable on a variety of lace-closable shoes for use with a lace-substitute hand-actuable shoe-closure system. The device is used with conventional shoes that include dual flaps positioned on opposing sides of a tongue, with each flap having plural, spaced openings formed in it for receiving a shoe lace. The attachment device includes buckle-like structure or plates positionable adjacent at least one opening in each flap, and constructed for handling via gross-motor hand movement. Also included is peg-like structure such as a threaded bolt associated with each buckle plate, and having a preselected length which allows it to extend through at least the one opening in each such flap. Fastener structure such as a tee nut is usable with the bolt to effect releasable, hand-actuable attachment of the buckle plate to each flap. The tee nut and buckle plate are constructed to allow such attachment via gross-motor hand movement by the user, and to provide ultimately for attachment to such shoes with flaps having thicknesses that vary from shoe to shoe. The device may also include a lace-substitute hand-actuable shoe-closure system which includes a closure strap. In an alternate embodiment, the fastener structure and peg-like structure may be formed in a unitary construction, with the peg-like structure having a terminal region being constructed to extend through the shoe-flap opening, and with attachment being achievable by constructing the peg-like structure for manually bending into a hook-like shape after the terminal region is placed through the opening.

3 Claims, 1 Drawing Sheet

ATTACHMENT DEVICE FOR USE WITH A LACE-SUBSTITUTE HAND-ACTUABLE SHOE-CLOSURE SYSTEM

This is a continuation of application Ser. No. 08/064,486 filed May 18, 1993 now abandoned.

BACKGROUND AND SUMMARY OF THE INVENTION

The present invention relates generally to shoe-closure devices. More particularly, the invention concerns a novel attachment device that is fittable on a variety of lace-closable shoes for use with a lace-substitute hand-actuable shoe-closure system.

Conventional lace-closable shoes are of course well known. Such shoes provide a satisfactory attachment mechanism for many applications. However, there are instances when a lace-closure mechanism is undesired or impractical. Such instances are substantial and involve certain classes of individuals who for various reasons are unable to accomplish lace closure. Those classes include: (1) people with rheumatoid arthritis, (2) people with weight problems who have difficulty bending over for the length of time required to perform lace closure, (3) people with Alzheimer's disease who have forgotten how to tie a shoe but may remember a simpler closure mechanism, (4) people with multiple sclerosis, (5) people with particular injuries that make it difficult for them to bend over for the length of time required to tie a shoe.

There are also those who need/desire an easier and quicker shoe-closure mechanism even though they are capable of accomplishing it. Such individuals include: (1) people with lower extremity edema who must adjust the snugness of their shoes frequently during an average day, (2) children, especially the very young, and (3) athletes.

To meet the need for a substitute to lace-closure of shoes, there have been several proposals. For example, U.S. Pat. No. 5,148,614 to Kelly shows shoe closure strap apparatus with opposing anchor plates and a strap that is extendable between the plates. The plates are attached to opposing flaps of a shoe by using lock pins or a fixed-position, lace-opening engagement hook.

None of the conventional devices proposed as substitutes to lace-closure is constructed for dealing with shoes of varying thicknesses. To provide a substitute closure mechanism usable on a variety of lace-closable shoes, the mechanism must work via an attachment mechanism that is operable on surfaces having various thicknesses.

Such attachment mechanisms of conventional devices are also deficient because they require relatively fine-motor hand activity. To allow use by people with little or no fine-motor hand function, such attachment mechanisms need to allow for attachment using gross-motor hand activity.

Accordingly, it is a principal object of the present invention to provide an attachment device for use with a lace-substitute hand-actuable shoe-closure system which overcomes the drawbacks of prior art systems.

Another object is to provide such a device that accommodates attachment to shoes with flaps of varying thicknesses.

Yet another object is to provide such a device that allows attachment using gross-motor hand activity.

Another important object of the invention is to provide such a device that provides a locking attachment as a way of preventing inadvertant release from a shoe during use.

Still another object is to provide such a device that promotes ease of actuation and self-stabilization when placed in a closure position;

Yet another object is to provide such a device that provides a fixed attachment to a desired shoe flap.

It is also an object of the invention to provide such a device that can be easily and cost-effectively manufactured.

In brief summary, one aspect of the invention includes an attachment device that is fittable on a variety of lace-closable shoes for use with a lace-substitute hand-actuable shoe-closure system. The attachment device is used with conventional shoes that include dual flaps positioned on opposing sides of a tongue, with each flap having plural, spaced openings formed in it for receiving a shoe lace. The attachment device includes (1) buckle-like structure positionable adjacent at least one opening in each flap, and constructed for handling via gross-motor hand movement, (2) peg-like structure associated with the buckle-like structure, and having a preselected length which allows it to extend through at least the one opening in each such flap, and (3) fastener structure usable with the peg-like structure to effect releasable, hand-actuable attachment of the buckle-like structure to each flap. The fastener structure and buckle-like structure are constructed to allow such attachment via gross-motor hand movement by the user, and to provide ultimately for attachment to such shoes with flaps having thicknesses that vary from shoe to shoe.

Another aspect of the invention is a substitute shoe-closure system that includes the above-described attachment device and a lace-substitute hand-actuable shoe-closure mechanism. That mechanism is characterized by closure structure being associable with the buckle-like structure, and being constructed for hand-actuable closure via gross-motor hand movement by the user, thereby to allow a wearer of such shoe to use the device as a substitute for lace closure.

For either aspect of the invention, the attachment device preferably includes the following other features:

(1) peg-like structure with a terminal region being constructed to extend through the opening, and fastener structure being selectively attachable to the peg-like structure at desired locations along its length to accommodate attachment to various shoes with openings of various depths;

(2) buckle-like structure made with first and second, spaced, substantially planar expanses, each expanse being positionable adjacent the at least one opening in each flap, and with the first expanse including a subsection oriented to extend at a preselected angle relative to the remainder of the first expanse, and wherein the closure structure is constructed for selective placement in a desired closure position bridging the space between the expanses, with the angled orientation of the subsection promoting ease of actuation and stabilization of the closure structure in the closure position;

(3) fastener structure also being constructed to provide locking attachment to the buckle-like structure as a way of preventing inadvertant release from the same while a user is wearing a shoe fitted with the device;

(4) closure structure including both elongate strap-like substructure movable to a closure position to attach it to the buckle-like structure, and holder substructure positionable adjacent the buckle-like structure for releasably holding a section of the strap-like substructure which extends beyond the buckle-like structure when the strap-like structure is moved to the closure position;

(5) holder substructure being formed with primary and auxiliary holder units, with the primary holder unit positionable on the first expanse, and the auxiliary holder unit releasably attachable to the shoe outwardly of the first expanse and away from the second expanse, the auxiliary holder unit thereby being capable of holding a section of the strap-like substructure that extends beyond the first expanse when the strap-like substructure is in the closure position; and (6) fastener structure further including barb-like substructure constructed to attach fixedly the fastener structure to each flap.

The attachment device of the present invention may alternatively be made with the fastener structure and the peg-like structure being provided in a unitary construction, and with the peg-like structure having a terminal region being constructed to extend through the opening in each flap. Attachment to the shoe is then achievable by constructing the peg-like structure for manually bending into a hook-like shape after the bottom region is placed through the opening.

These and other objects and advantages of the invention will be more clearly understood from a consideration of the accompanying drawings and the following description of the preferred embodiment.

DETAILED DESCRIPTION OF THE PREFERRED EMBODIMENT

Figure 1:
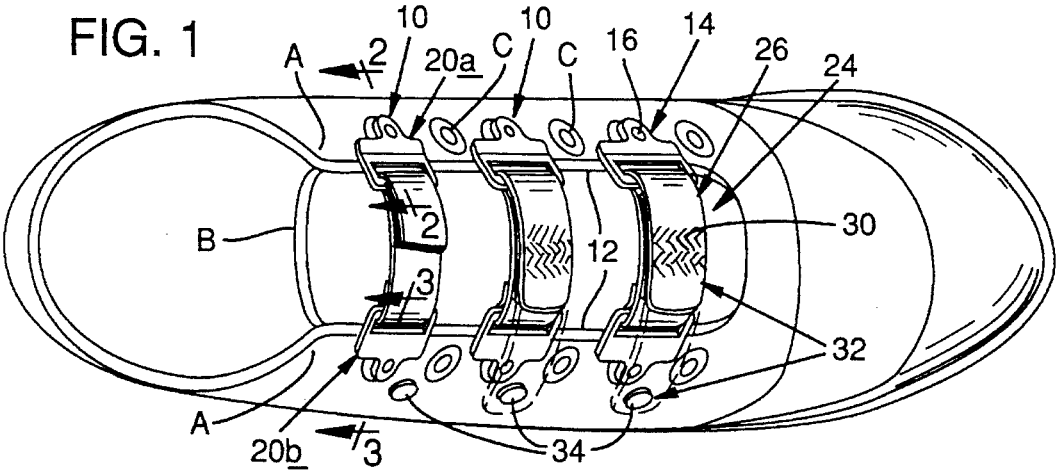
FIG. 1 is a top plan view showing the preferred embodiment of the attachment device of the present invention in use on a conventional, lace-closable shoe.

FIG. 1 depicts a top view of plural attachment devices of the present invention, each made in accordance with its preferred embodiment and indicated at 10. A right shoe 12 is also shown, which shoe is of the conventional lace-closable type. Shoe 12 includes dual flaps A positioned on opposing sides of a tongue B. Generally speaking, various shoes will each have flaps like flaps A, and such flaps will have thicknesses that vary from shoe to shoe. Referring again to FIG. 1, each flap A has plural, spaced openings, or eyelets, C formed in it for receiving a shoe lace (undepicted). It is also understood that each opening has a depth corresponding to the thickness of the flap in which it is formed plus the added thickness from the usual grommet or other lining applied to the opening along its edge as a way of providing a finished edge.

Figure 2:
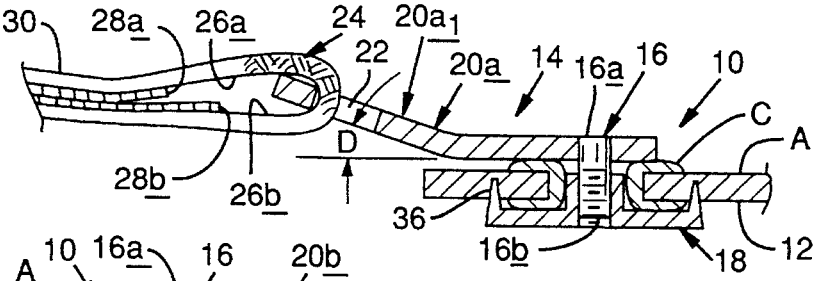
FIG. 2 is a fragmentary, cross-sectional view through line 2—2 of FIG. 1.
Figure 3:
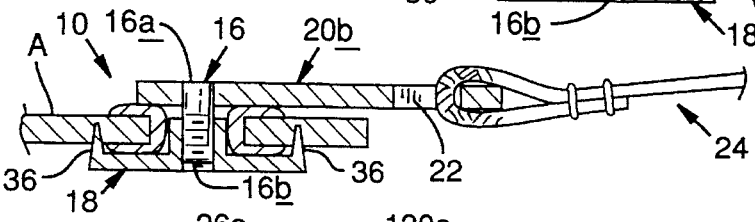
FIG. 3 is a fragmentary, cross-sectional view through line 3—3 of FIG. 1.
Figure 7:
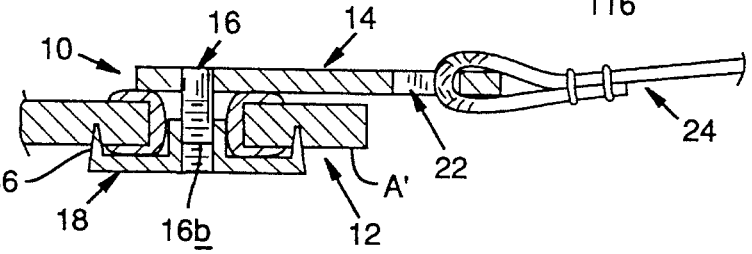
FIG. 7 is a fragmentary cross-sectional view like FIG. 3 only showing attachment to a shoe flap having a greater thickness than that depicted in that figure.

Referring to FIGS. 2–5, each attachment device 10 includes buckle-like structure 14, peg-like structure 16, and fastener structure 18. Each of these structures may be formed from any suitable material such as plastic or metal. Buckle-like structure 14 is positionable adjacent at least one opening C in each flap A, and is constructed for handling via gross-motor hand movement. Peg-like structure 16 is associated with the buckle-like structure, includes a top region **16*a* and a bottom, or terminal, region 16*b*, and has a preselected length 16*c* which allows it to extend through at least the one opening C in each such flap A. Terminal region 16*b* is constructed to extend through opening C so that fastener structure 18 is selectively attachable to it at desired locations along length 16*c* (FIG. 5) to accommodate attachment to various shoes with openings of various depths. For example, FIG. 3 shows selective attachment of terminal region 16*b* and fastener structure 18 on a shoe flap A of one thickness, and FIG. 7 shows selective attachment of terminal region 16*b* and fastener structure 18** on a shoe flap A' of another, greater thickness.

Figure 5:
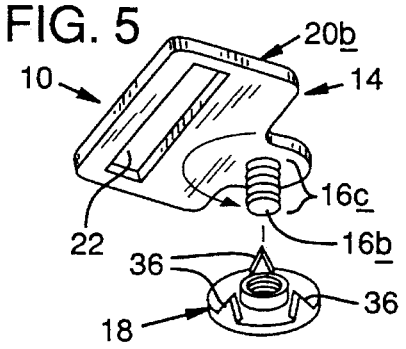
FIG. 5 is a partially exploded, isometric view of the preferred embodiment of the attachment device of the present invention, with the fastener structure having been rotated on a horizontal axis in the plane of the paper as a way of better illustrating certain features.

Referring to FIGS. 2–3, and 5, peg-like structure 16 is preferably constructed as a threaded bolt with a top region **16*a* fixedly attached to the plate, a central region 16*c* having a preselected length to allow it to extend through the opening in each flap, and a bottom region 16*b* receivable in the fastener structure as will be described. The presently preferred way to attach fixedly top region 16*a* of each bolt to each corresponding plate 20*a,b***, is to place the top region in a corresponding hole formed in the plate, and press, weld, or otherwise adhere that region to the plate.

Referring again to FIGS. 2–5, fastener structure 18 is usable with peg-like structure 16 to effect releasable, hand-actuable attachment of buckle-like structure 14 to each flap. As will be described, fastener structure 18 and buckle-like structure 14 are constructed to allow such attachment via gross-motor hand movement by the user, and to provide ultimately for attachment to such shoes with flaps having thicknesses that vary from shoe to shoe.

Referring to FIGS. 1–5, preferably buckle-like structure 14 includes first and second, spaced, substantially planar expanses, or buckle plates **20*a,b*. For reasons to be described, first plate 20*a* includes a subsection $\mathbf{20}a_1$ (FIG. 2) oriented to extend at a preselected angle D relative to the remainder of the first plate. Each plate is formed with an aperture 22** for receiving to-be-described closure structure.

Referring to FIGS. 2, 3 and 5, peg-like structure 16 is preferably constructed with top region **16*a* fixedly attached in a corresponding hole formed in buckle-like structure 14. However, peg-like structure 16 could also be fixedly attached to fastener structure 18 and received in a threaded hole (undepicted) formed in buckle-like structure 14**.

Figure 4:
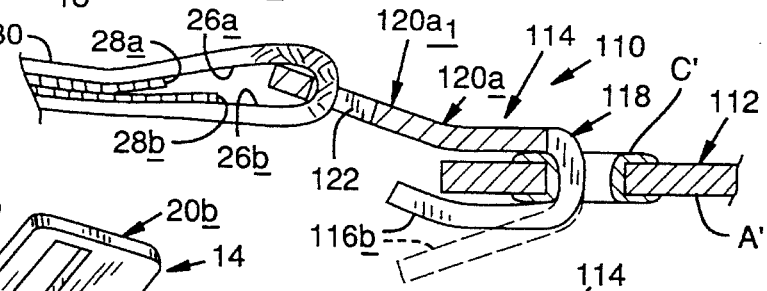
FIG. 4 is like FIG. 2, only showing a second, alternative embodiment of the attachment device of the present invention.
Figure 6:
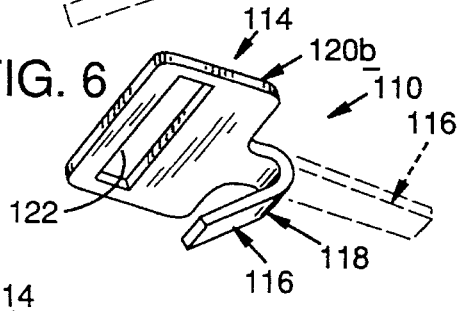
FIG. 6 is an isometric view of the second, alternative embodiment of the attachment device of the present invention.

Referring to FIGS. 4 and 6, an alternative embodiment of the attachment device of the present invention is shown at 110, including buckle plates **120*a,b*, peg-like structure 116, and fastener structure 118. Peg-like structure 116 and fastener structure 118 are formed in a unitary construction, and the peg-like structure has a terminal region 116*b* that extends through eyelet C' (FIG. 4). Attachment to flap A' of shoe 112 is achieved by constructing the peg-like structure and fastener structure for manually bending into a hook-like shape after the terminal region is placed through opening C'. For such attachment peg-like structure 116 is preferably made from a material that is malleable and shape-retentive, thereby to allow for bending and unbending (FIG. 6) so that device 110** may be reused. Aluminum is the presently preferred choice for such material.

Referring back to FIGS. 1–3, attachment device 10 preferably further includes a lace-substitute hand-actuable shoe-closure system 24 that is characterized by closure structure 26 being associable with buckle plates 20*a,b*. As will be described, closure structure 26 is constructed for hand-actuable closure via gross-motor hand movement by the user, thereby to allow a wearer of such shoe to use the device as a substitute for lace closure.

Referring to FIG. 1, closure structure 26 is constructed for selective placement in a desired closure position (shown in solid lines) bridging the space between opposing plates 20*a,b*. Closure structure 26 has one end suitably attached to one plate (see plate 20*b* in FIG. 3), and the other end movable through an aperture formed in the other plate (see plate 20*a* in FIG. 2). Closure structure 26 includes contactable surfaces 26*a,b*, respectively, with each being having applied to them complementary hook-and-loop fastener material 28*a,b* so that the closure structure may be looped through the aperture and pressed back against itself (FIG. 2) to allow for hand-actuable closure via gross-motor hand movement by the user. Such hook-and-loop fastener material is commercially available under the trademark VELCRO.

Before describing closure structure 26 further, the reader is directed for a moment to FIG. 2. In the context of looping the strap through aperture 22, it will be appreciated that the angled orientation of subsection $\mathbf{20}a_1$ promotes ease of actuation and stabilization of the closure structure in the closure position. The upward angle provides a space between either the tongue and/or flap relative to the plate, with such orientation providing easy feeding of the closure structure through aperture 22 as will be described.

Continuing with the description of closure structure 26 shown in FIGS. 1–3, it includes elongate strap-like substructure 30, also referred to herein as a closure strap. Closure strap 30 is movable to a closure position (FIG. 1) to attach closure structure 26 to plates 20*a,b*. Referring to the dashed lines in FIG. 1, closure structure 26 also preferably includes holder substructure 32. Referring to FIGS. 1–2, holder substructure 32 may be thought of as being formed with primary and auxiliary holder units. The primary holder unit is material 28*a,b* which allows for attachment relative to plate 14. The auxiliary holder unit is tab 34 which is releasably attachable to the shoe, via a suitable adhesive, outwardly of second plate 20*b* and away from first plate 20*a*. The auxiliary holder unit is made from material like fastener material 28*a,b* so that it is constructed to hold a section of the closure strap that extends beyond second plate 20*b* when the closure strap is in the closure position. Representative sections that extend beyond second plate 20*b* are shown by dashed lines in FIG. 1.

Referring to FIGS. 2, 3, 5 and 7, fastener structure 18 preferably further includes barb-like substructure 36 constructed to attach fixedly the fastener structure to each flap when the fastener structure is actuated by attaching (e.g. screwing) to the buckle plates.

Operation

Referring to FIGS. 1–3, in operation the user attaches device 10 to shoe flaps A by inserting terminal region 16*b* of peg-like structure 16 through a desired eyelet C. Next, the user places fastener structure 18, preferably a locking nut such as a tee nut, against the terminal region that extends below the eyelet adjacent the underside of the flap. Next, referring particularly to FIG. 5, the user rotates plate 20*b* clockwise in the direction of the arrow to drive a terminal end of peg-like structure (preferably a threaded bolt) 16 into the threaded bore of tee nut 18. The threaded connection between the bolt and nut provide a locking attachment to the buckle plates as a way of preventing inadvertant release from the same while a user is wearing a shoe fitted with the device.

The reader will also appreciate that attachment of device 10 can be accomplished via gross-motor hand activity because the user drives bolt 16 into nut 18 by rotating a relatively larger object, a buckle plate such as plate 20*a*. The result is that people with reduced motor function in their hands can attach device 10 to a shoe such as shoe A.

From the above description, the reader will appreciate that each plate 20*a,b* will allow for attachment at desired locations along a preselected range of the length of each bolt. The result is to accommodate attachment to various shoes with openings of various depths, such as the openings of different depths shown in FIGS. 3 and 7. It is also presently preferred to use a tee nut as fastener structure 18 because such a nut is designed for tightening relative to the bolt without having a terminal end of the bolt protrude outwardly (i.e. downwardly) from it. The reader will appreciate that fastener structure other than tee nuts, such as other types of nuts, are designed for tightening to a bolt in such a way that a section of the bolt may extend all the way through the nut. It is undesirable to have such a situation when using attachment device 10 because such a section of the bolt may cause discomfort to the wearer of a shoe fitted with device 10. That is, the bolt may undesirably extend down below the eyelet and press against the foot. By preferably including a tee nut as fastener structure, the present invention even further assures no shoe-wearer discomfort.

Referring to FIGS. 1–2, holder substructure 32 provides a primary holder unit in material 28*a,b* which holds closure strap 30 against itself after being looped through aperture 22 of plate 20*a*. Holder substructure 32 also provides an auxiliary holder unit in tabs such as tab 34 which is releasably attachable to shoe 12, via a suitable adhesive (undepicted), outwardly of second plate 20*b* and away from first plate 20*a*. Referring to FIG. 1, the auxiliary holder unit is thereby capable of holding a section of the closure strap that extends beyond second plate 20*b* when the closure strap is in the closure position.

Referring to FIG. 5 and then FIGS. 2–3, rotation of each buckle plate drives a corresponding bolt into a corresponding tee nut, and causes barb-like substructure 36 to protrude into the underside of flap A to attach fixedly the tee nut to that flap.

Referring to FIGS. 4 and 6, the alternative embodiment of the attachment device of the present invention is also usable with a shoe like shoe 12. Fastener structure 118 and peg-like structure 116 are provided in a unitary, construction, and terminal region 116*b* is extendable through eyelet C'. Attachment is achieved by manually bending the unitarily constructed fastener/peg-like structure into a hook-like shape after terminal region 116*b* is placed through eyelet C'. Of course the desired location for bending of peg-like structure 116 into a hook-like shape will vary depending on the thickness of the flap to which device 110 is being attached.

The present invention thus achieves the above objects by providing an attachment mechanism that is operable on surfaces (i.e. shoe flaps) having various thicknesses. The present invention also provides an attachment mechanism that is actuated by using gross-motor hand activity. The present invention also includes an attachment mechanism that provides a locking attachment as a way of preventing inadvertant release from a shoe during use. Also, the attachment device of the present invention promotes ease of actuation and self-stabilization when placed in a closure position via the angled orientation of one buckle plate in each pair of plates (i.e. plate 20*a* of pair 20*a,b*). The present invention also provides a fixed attachment to a desired shoe flap via barb-like substructure 36. It is also possible to easily and cost-effectively manufacture the present invention.

Accordingly, while a preferred embodiment of the invention has been described herein, it is appreciated that modifications are possible that are within the scope of the invention.

It is claimed and desired to secure by Letters Patent:

1. A substitute shoe-closure device fittable on a variety of lace-closable shoes, with each such shoe including dual flaps positioned on opposing sides of a tongue, with the flaps having thicknesses that vary from shoe to shoe, with each flap having plural, spaced openings formed in it for receiving a shoe lace, and with each opening having a depth corresponding to the thickness of the flap in which it is formed, the attachment device comprising:

buckle-like structure positionable adjacent at least one opening in each flap, the buckle-like structure including a generally planar member having proximal and distal regions, and a slotted aperture in the distal region for receiving a closure strap, the planar member constructed to define an expanse that facilitates handling via gross-motor hand movement;

peg-like structure fixedly attached to the buckle-like structure in the proximal region of the planar member, and having a preselected length which allows it to extend through at least one opening in each such flap toward an inside of such shoes, the peg-like structure including an elongate threaded member; and fastener structure usable with the peg-like structure and constructed for hand-actuable, retrofittable attachment to each flap for ultimate releasable, hand-actuable attachment of the buckle-like structure to each flap, with the fastener structure including a threaded region for threadably mating with the threaded member of the peg-like structure, the fastener structure further including a base with a bottom surface that is accessible to the hand of the user during attachment to the shoe without disassembling the shoe, thereby to allow hand-actuable retrofittable shoe attachment, the base also including plural hooks for penetrating a bottom surface of such flap to prevent rotation of the base relative thereto when the peg-like structure and fastener structure are threadably attached by manual rotation of the buckle-like structure about an axis defined by the long axis of the peg-like structure, thereby to allow such attachment via gross-motor hand movement by the user, and to provide ultimately for attachment of the device to such shoes.

2. A substitute shoe-closure device fittable on a variety of shoes constructed for lace closure, with each such shoe including dual flaps positioned on opposing sides of a tongue, with the flaps having thicknesses that vary from shoe to shoe, with each flap having plural, spaced openings formed in it for receiving a shoe lace, and with each opening having a depth corresponding to the thickness of the flap in which it is formed, the shoe-closure device comprising:

opposing, spaced buckle plates each being positionable adjacent the top of at least the one opening in each flap, and each including a threaded bolt with a top region fixedly attached to the plate, a central region having a preselected length to allow it to extend through the opening in each flap, and a bottom region;

dual locking nuts each being positionable adjacent the underside of a corresponding opening in each flap, and each being constructed for receiving the threaded bolt so that rotating each plate will accommodate releasable hand-actuable attachment of the device to the shoe via gross-motor hand movement by the user, and allow for such attachment along a preselected range of the length of each bolt also to accommodate attachment to various shoes with openings of various depths;

a closure strap with one end attached to one plate and the other end movable through an aperture formed in the other plate, with the strap including top and bottom surfaces each being made with complimentary hook-and-loop fastener material so that the strap may be looped through the aperture and pressed back against itself to allow for hand-actuable closure via gross-motor hand movement by the user, with the other plate including a subsection oriented to extend at a preselected, upwardly-extending angle relative to the remainder of that plate, and wherein the closure strap is constructed for selective placement in a desired closure position bridging the space between the plates, with the angled orientation of the subsection promoting ease of actuation and stabilization of the closure strap in that position; and an auxiliary strap-holder member with a bottom surface releasably attached to the shoe outwardly of the other plate and away from the one plate, and a top surface having a hook-and-loop fastener material complimentary to the bottom surface of the closure strap, thereby to hold a section of the closure strap that extends beyond the other plate away from the one plate when the strap is in the closure position, thereby to allow a wearer of such shoe to use the device as a substitute for the lace-closure construction.

3. An attachment device fittable on a variety of lace-closeable shoes, with each such shoe including dual flaps positioned on opposing sides of a tongue, with the flaps having thicknesses that vary from shoe to shoe, with each flap having plural, spaced openings formed in it for receiving a shoe lace, and with each opening having a depth corresponding to the thickness of the flap in which it is formed, the attachment device comprising:

a buckle-like structure positionable adjacent at least one opening in each flap, and constructed for handling via gross-motor hand movement;

a peg-like structure fixedly attached to the buckle-like structure, and having a preselected length which allows it to extend through at least the one opening in each such flap, the peg-like structure including an elongate threaded member;

a fastener structure useable with the peg-like structure and constructed for releasable, hand-actuable attachment of the buckle-like structure to each flap, with the fastener structure including a threaded region for threadably mating with threaded member of peg-like structure, thereby allowing such attachment via gross-motor hand movement by the user, and to provide ultimately for attachment to such shoes; and lace-substitute hand-actuable shoe-enclosure structure being associable with the buckle-like structure, and being constructed for hand actuable closure via gross-motor hand movement by the user, thereby to allow a wearer of such shoe to use the device as a substitute for lace closure, with the closure structure including both elongate strap-like substructure movable to a closure position to attach it to the buckle-like structure, and holder substructure positionable adjacent the buckle-like structure for releasably holding a section of the strap-like substructure which extends beyond the buckle like structure when the strap-like structure is moved to the closure position, wherein the holder substructure is formed with primary and auxiliary holder units, with the primary holder unit positionable on the first expanse, and the auxiliary holder unit releasably attachable to the shoe outwardly of the first expanse and away from the second expanse, the auxiliary holder unit thereby being capable of holding a section of the strap-like substructure that extends beyond the first expanse when the strap-like substructure is in the closure position.

* * * * *